US006249209B1

(12) United States Patent
Yu

(10) Patent No.: US 6,249,209 B1
(45) Date of Patent: Jun. 19, 2001

(54) SWITCH STRUCTURE HAVING A CURRENT OVERLOADING PROTECTION MECHANISM

(76) Inventor: Tsung-Mou Yu, No. 4, Alley 2, Lane 23, Sec. 3, Pa Te Rd., Panchiao, Taipei (TW)

( * ) Notice: Subject to any disclaimer, the term of this patent is extended or adjusted under 35 U.S.C. 154(b) by 0 days.

(21) Appl. No.: 09/398,973

(22) Filed: Sep. 17, 1999

(51) Int. Cl.[7] ..... H01H 37/02; H01H 37/32; H01H 37/46

(52) U.S. Cl. ..... 337/37; 337/39; 337/59; 337/85; 337/112; 337/113; 337/66; 337/74

(58) Field of Search ..... 337/379, 79, 59, 337/66, 76, 53, 67–69, 74, 75, 91, 39, 85, 112, 113, 140, 334, 345; 200/553–557

(56) References Cited

U.S. PATENT DOCUMENTS

| | | | | |
|---|---|---|---|---|
| 3,358,099 | * | 12/1967 | De Bellomayre | 200/113 |
| 4,258,349 | * | 3/1981 | Flory | 337/46 |
| 4,345,233 | * | 8/1982 | Matthies | 337/75 |
| 4,528,538 | * | 7/1985 | Andersen | 337/43 |
| 4,931,762 | * | 6/1990 | Fierro | 337/66 |
| 5,012,495 | * | 4/1991 | Munroe et al. | 337/3 |
| 5,262,748 | * | 11/1993 | Tsung-Mou | 337/66 |
| 5,451,729 | * | 9/1995 | Onderka et al. | 200/18 |
| 5,541,569 | * | 7/1996 | Jang | 337/68 |
| 5,760,672 | * | 6/1998 | Wang | 337/79 |
| 5,828,284 | * | 10/1998 | Huang | 337/37 |
| 5,847,638 | * | 12/1998 | Sorenson | 337/380 |
| 5,889,457 | * | 3/1999 | Hsu et al. | 337/59 |
| 5,892,426 | * | 4/1999 | Huang | 337/59 |
| 5,898,355 | * | 4/1999 | Yu | 337/8 |
| 6,072,381 | * | 6/2000 | Yu | 337/37 |
| 6,094,126 | * | 7/2000 | Sorenson | 337/37 |
| 6,121,868 | * | 9/2000 | Chiang | 337/37 |
| 6,154,116 | * | 11/2000 | Sorenson | 337/37 |

FOREIGN PATENT DOCUMENTS

| | | | | |
|---|---|---|---|---|
| 647094 A5 | * | 12/1984 | (CH) | 337/333 |
| 19534611 | * | 3/1996 | (DE) | H01H/23/20 |

* cited by examiner

*Primary Examiner*—Leo P. Picard
*Assistant Examiner*—Anatoly Vortman

(57) ABSTRACT

A switch structure comprises a switch case, a switch, a contact reed, a control element, a swinging device, and an alloy piece. The swinging device is assembled with the control element. The switch is coupled with the contact reed. When the alloy piece is overheated due to current overloading, it is deformed towards the control element so as to push the swinging device that is then swung away and released from the support of the switch case. As a result, the control element moves towards to an original off position. An elastic contacting piece is released from the pressing of the control element so as to be ejected upwards and break the power supply.

6 Claims, 4 Drawing Sheets

SWITCH STRUCTURE HAVING A CURRENT OVERLOADING PROTECTION MECHANISM

FIELD OF THE INVENTION

The present invention relates to a switch structure, and more specifically to a switch structure with a protection mechanism for automatically turning off the switch when it is overloaded with current.

BACKGROUND OF THE INVENTION

In general, a conventional switch has two states. The switch can be turned on or off manually. For normal operation, the two states are adequate to control the power supplied to an electrical appliance or electronic device. The conventional switch has a drawback that no protection is provided. As long as the switch is turned on, it stays on until it is turned off, damaged, or burned off.

In an area where electric power is not very stable, current overloading may occur frequently to a switch that controls the power supply. If the current overloading is not detected and the switch continues to operate, it is usually overheated and eventually burned out. Therefore, the current overloading problem not only results in the loss of a switch but also presents a risk of fire if it can not be detected and protected. There is a strong demand in having a switch with a protection mechanism to detect and avoid current overloading.

SUMMARY OF THE INVENTION

The present invention has been made to overcome the above-mentioned drawback of a conventional switch. The primary object of the invention is to provide a switch that comprises a protection structure to automatically detect the current overloading and restore the switch to an OFF state.

Accordingly, the switch structure of the invention comprises a switch case, a switch, a contact reed, a control element, a swinging device, an alloy piece and an elastic contacting piece. The alloy piece is deformed to eject the swinging device when it is overheated. The ejection of the swinging device also trips the elastic contacting piece and breaks the power supply provided through the elastic contacting piece. By means of the contact reed and the control element, the switch is automatically restored to an OFF state to be turned on again.

The various objects and advantages of the present invention will be more readily understood from the following detailed description when read in conjunction with the appended drawing.

DETAILED DESCRIPTION OF THE PREFERRED EMBODIMENTS

Figure 1:
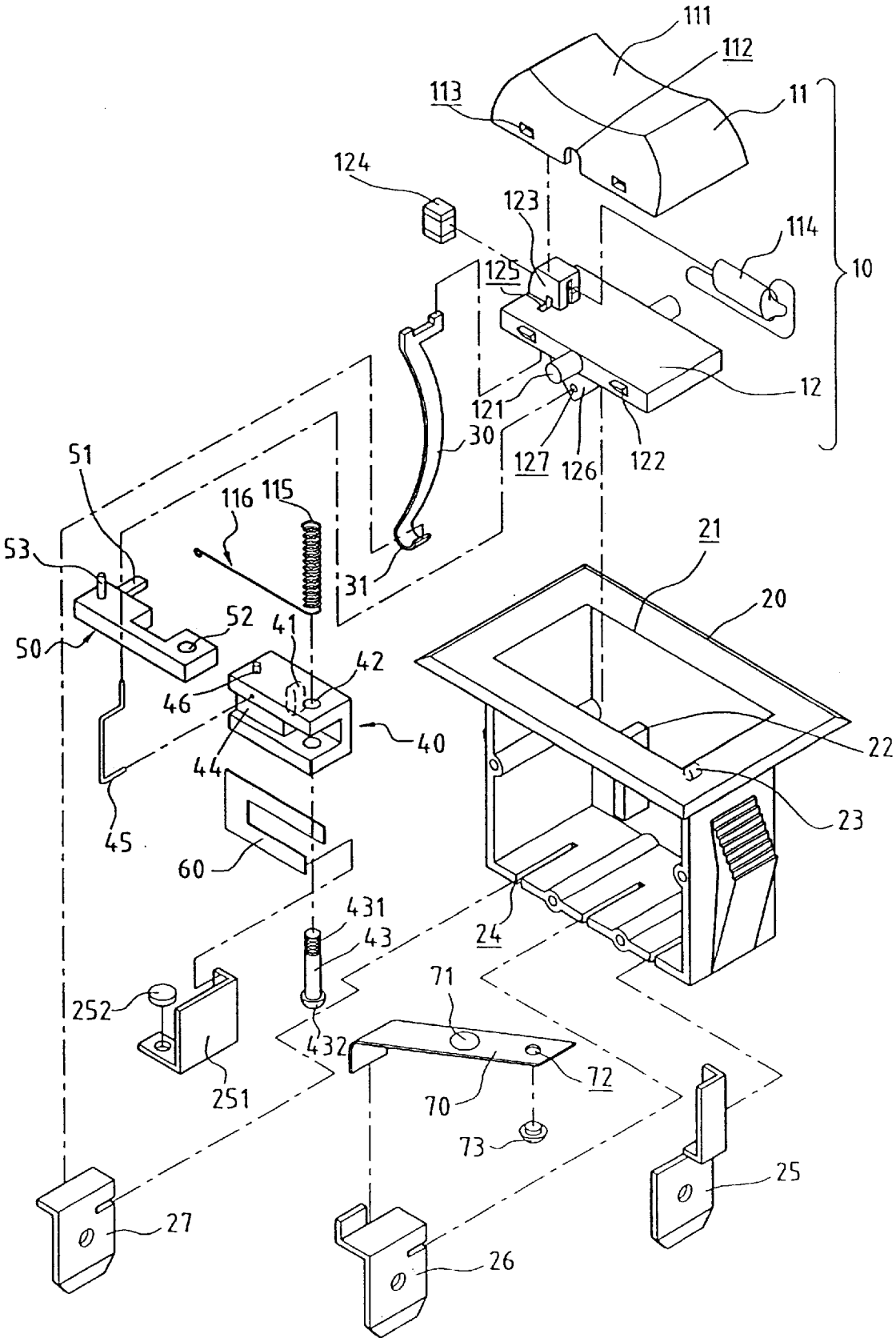
FIG. 1 is an exploded perspective view of the present invention.

With reference to FIG. 1, the exploded perspective view of the switch structure according to the present invention is illustrated. The switch structure of the present invention includes a switch 10, a switch case 20, a contact reed 30, a control element 40, a swinging device 50, an alloy piece 60, and an elastic contacting piece 70.

The switch 10 comprises a switch cover 11 and a switch seat 12. The surface of the switch cover 11 has a concave cambered surface 111. Axial holes 112 and buckling holes 113 are formed at the proper locations at the two sides thereof. Two fulcrums 121 and two tenons 122 are installed on the switch seat 12 at corresponding locations with respect to the axial holes 112 and buckling holes 113 in order to engage with the switch cover 11 and allow it to be pressed in two positions supported by the fulcrum 121 and the switch seat 12. A resistor seat 123 is protruded from one side of the switch seat 12. A chip resistor 124 can be embedded into the seat as a current confining resistor of a neon lamp 114 enclosed within the switch 10 for indicating if the switch is ON or not. On the switch seat 12 through holes 125 are formed on both sides of the resister seat 123 for the contact reed 30 to contact the chip resistor 124. The bottom of the switch 12 is installed with a triangular piece 126. A hole 127 for supporting a rod is formed on the triangular piece 126.

The switch case 20 comprises a hollow shell with an opening 21. A stopper 22 and a fixing pillar 23 are installed at proper locations on the inner wall of the shell. The switch 10 can be inserted into the case through the opening 21. A plurality of grooves 24 are formed at the bottom of the switch case for receiving first, second and third contact terminals 25, 26 and 27. The first contact terminal 25 is connected to the alloy piece 60 to contact a conductive piece 251. An upper contact 252 is combined with the conducting piece 251 by riveting connection.

The contact reed 30 has one end passes through the through holes 125 to contact with the chip resistor 124. Another end is bent to form a hook 31 so as to be firmly combined with the third contact terminal 27 for providing a dynamic resilient force against the switch 10 and for electrically connecting one leg of the neon lamp 114.

The control element 40 has an approximate U shape. One side thereof has a fixing groove 41 with an upright oblong shape for engaging with the fixing pillar 23 installed on the switch case 20. Through holes 42 are formed on the control element 40 for receiving a metal rod 43. A hole 44 is also formed on the control element 40 for receiving a supporting rod 45 which is coupled to the triangular piece 126 through the supporting rod hole 127 at the bottom of the switch seat 12 so that the swinging device 50 can be driven by pressing the switch 10. A fulcrum post 46 is protruded from the upper side of the control element 40. Thereby, an elastic element 116 can be assembled with the swinging device 50.

One side of the swinging device 50 has a protruded portion 51. Thereby, as the alloy piece 60 is thermally expanded, it will push against the swinging device 50. Another end of the swinging device 50 has a through hole 52. This through hole 52 is matched with the through hole 42 of the control element 40 for passing through by the metal rod 43. The swinging device 50 can be swung around the metal rod 43. A resisting post 53 is formed near the protruded portion 51 on the upper surface of the swinging device 50. A linear elastic element 116 extended from the distal end of a helical spring 115 is located between the convex resisting post 53 and the fulcrum post 46 when the control element 40 and the swinging device 50 are assembled together. Thus, the swinging device 50 is positioned against the control element 40 by the elastic force of the elastic element 116.

Figure 2:
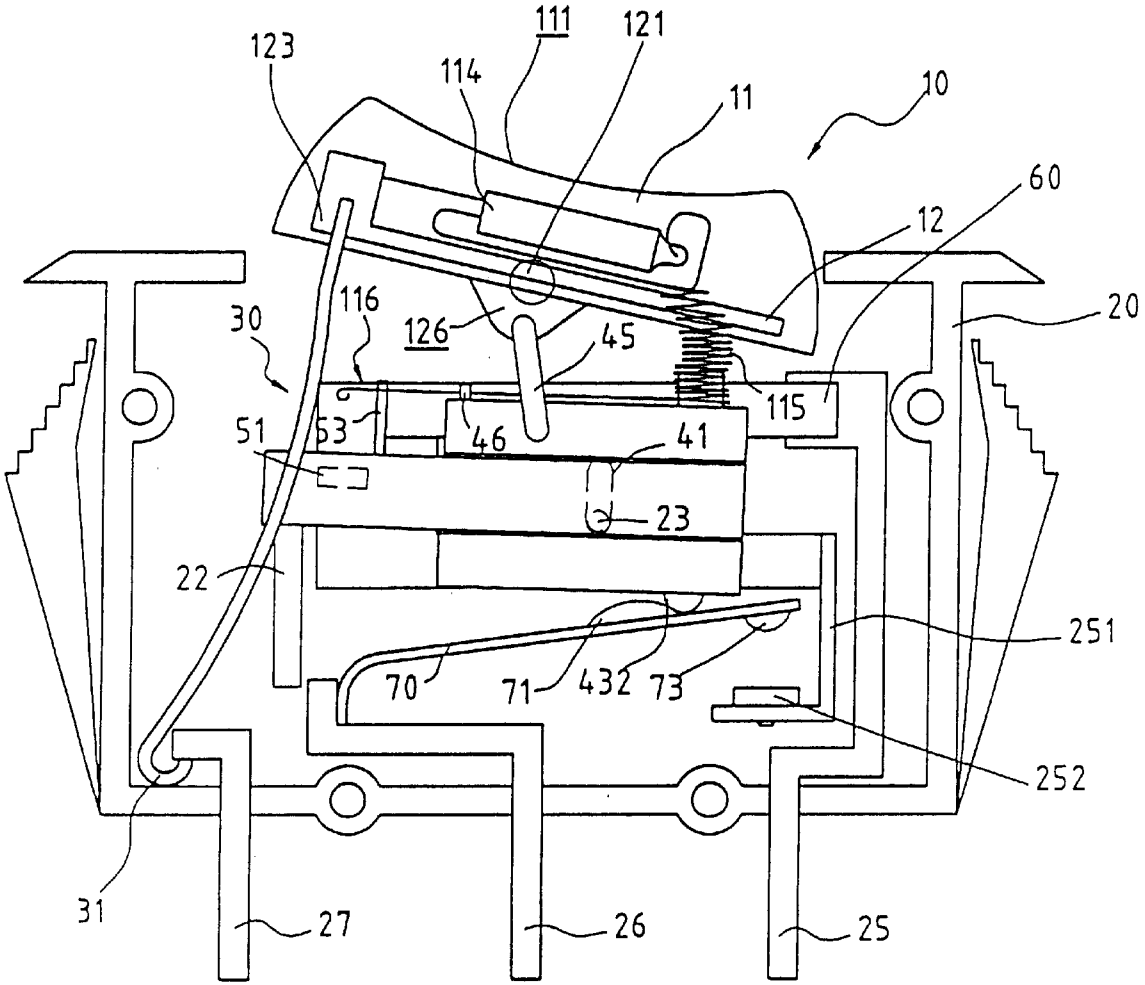
FIG. 2 is a cross sectional view of the present invention showing that the switch of the present invention is in an OFF state.

One end of the metal rod 43 is formed with a thread 431. Another end thereof is installed with a round head 432. The metal rod 43 passes through the through holes 42 of the control element 40 from the lower portion to the upper portion and the through hole 52 of the swinging device 50. The thread 431 protruded above the swinging device 50 is fixed with the helical spring 115. The helical spring 115 is connected to another leg of the neon lamp 114 as shown in FIG. 2. Thus, the neon lamp is formed with a complete electric loop.

The alloy piece 60 having an approximate U shape is positioned at one side of the control element 40 and fixed to the contact terminal 25. The elastic contacting piece 70 is fixed to the second contact terminal 26 at one end thereof. The top of the elastic contacting piece 70 is formed with a round convex portion 71. The front end thereof has a joint hole 72, and a lower contact 73 is affixed from the bottom by a rivet.

The actions of the switch in the present invention include OFF, ON, and Trip as the power is overloaded. The detail of the actions will be described in the following. The cross sectional view of the present invention is shown in FIG. 2 in which an OFF state of the switch set by a user is illustrated. When a user presses the switch 10 on the right side, the contact reed 30 extends with this action so that the switch 10 rotates clockwise around the fulcrum 21. The supporting rod hole 127 moves along an arc clockwise around the fulcrum 121 so that the upper end of the supporting rod 45 moves in the same direction. The hole 44 of the control element 40 is driven by the lower end of the supporting rod 45 to pull the control element 40 upwards. Thus, the round head 432 of the metal rod 43 stops applying any pressure to the round convex portion 71 of the elastic contacting piece 70 which then moves upwards. Therefore, the lower contact 73 is separated from the upper contact 252 and the first contact terminal 25 is disconnected from the second contact terminal 26 so that the power supply is cut off. At the same time, the neon 114 is extinguished because of no power input from the second contact terminal 26, thus indicating an OFF state.

Figure 3A:
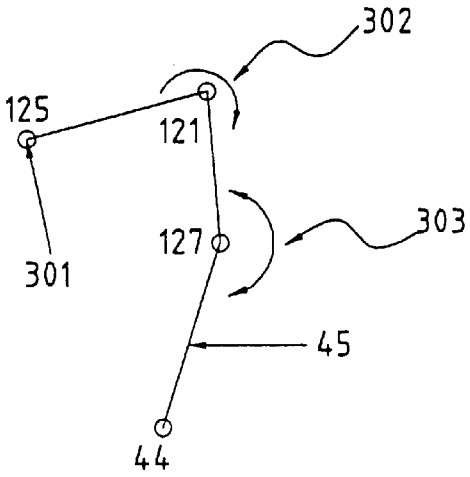
FIG. 3 is a cross sectional view of the present invention showing that the switch of the present invention is in an ON state.
Figure 3:
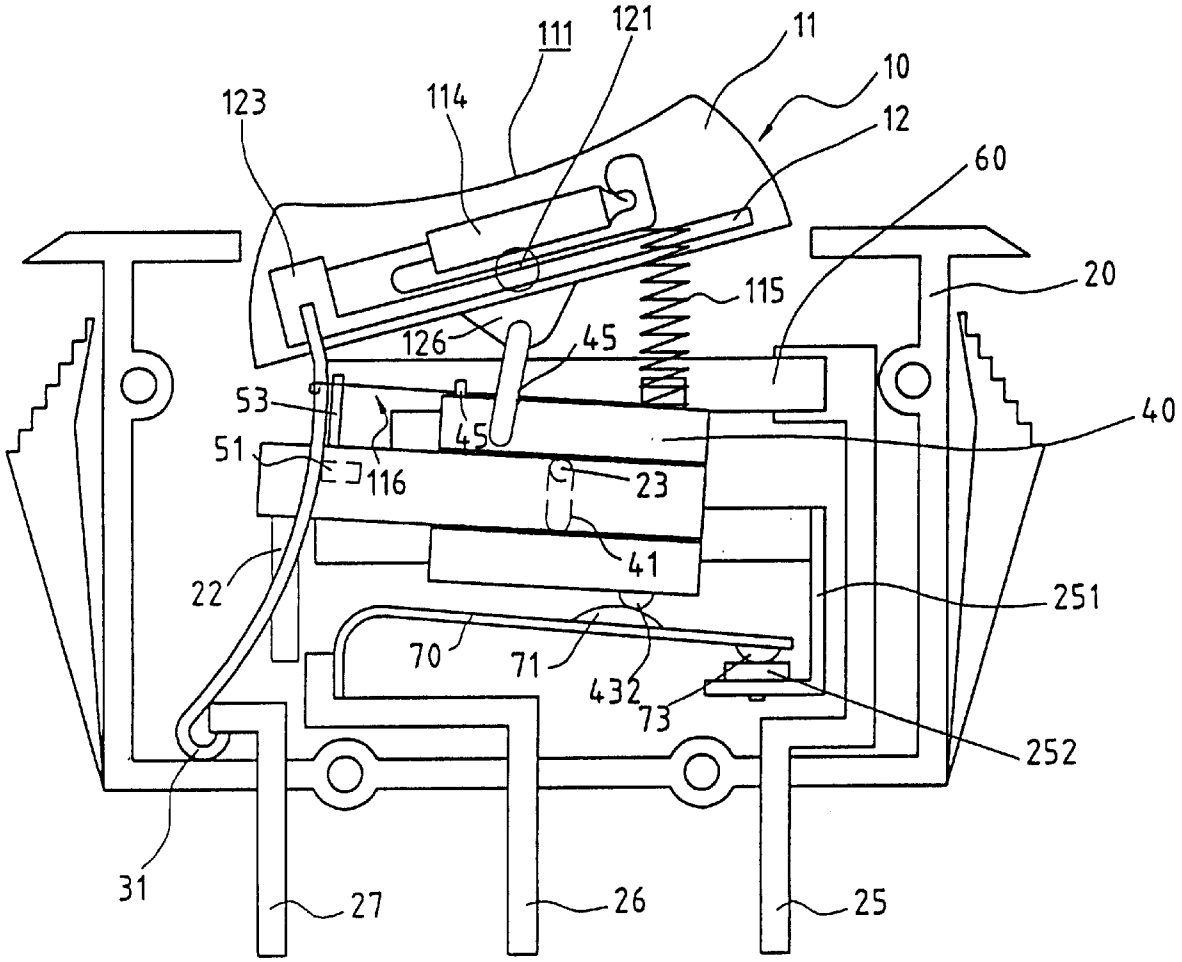

As shown in FIG. 3, the cross sectional view of the ON state of the switch of the present invention is illustrated. When the switch 10 is pressed towards the left, the contact reed 30 is pressed downwards and deformed to allow the switch 10 to rotate counterclockwise around the fulcrum 121. The upper end of the supporting rod 45 moves rightwards and downwards. The hole 44 of the control element 40 is driven by the lower end of the supporting rod 45 to push the control element 40 downwards. Thus, the round head 432 of the metal rod 43 applies pressure to the round convex portion 71 of the elastic contacting piece 70. The lower contact 73 of the elastic contacting piece 70 then contacts the upper contact 252 of the conducting piece 251. Therefore, current flows to the second contact terminal 26 through the first contact terminal 25, the conducting piece 251, the upper contact 252, the lower contact 73, and the elastic contacting piece 70 so that a complete electric path is formed and the switch is in an ON state.

After the aforementioned electric path is formed, power will be supplied to one pin of the neon lamp 114 through the helical spring 115. Another pin of the neon lamp 114 is connected to the third contact terminal 27 through the chip resistor 124 and the contact reed 30 so as to form an electric loop. The neon lamp 114 is turned on to indicate that the switch is ON.

With reference to FIG. 3A, when the switch in an ON state, the contact reed 30 is in a pressed condition, the upward restoring resilient force 301 is stored. Because the through hole 125 is a force applying point and the fulcrum 121 is an axial center, the distance from the through hole 125 to the fulcrum 121 is an arm of force and a moment of force 302 is generated. The angle 303 formed with a top point at the supporting rod hole 127 and two sides from the top point to the fulcrum 121 and the hole 44 is slightly larger than 180 degrees. By means of the upward ejecting force of the elastic contacting piece 70, the switch 10 in an ON state can be maintained.

The control element 40 is swung upwards and downwards along the fixing groove 41 with the fixing pillar 23 restrained therein. It should be noted that when the aforementioned switch is turned off or on, the switch is in a normal OFF or ON position. The lower side of the swinging device 50 is supported by the upper surface of the stopper 22 without any action being generated.

Figure 4A:
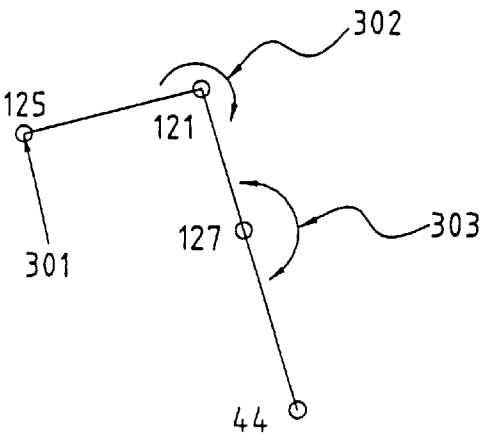
FIG. 4 is a cross sectional view schematically showing that the electric loop of the present invention is tripped open as it is overloaded with current.
Figure 4:
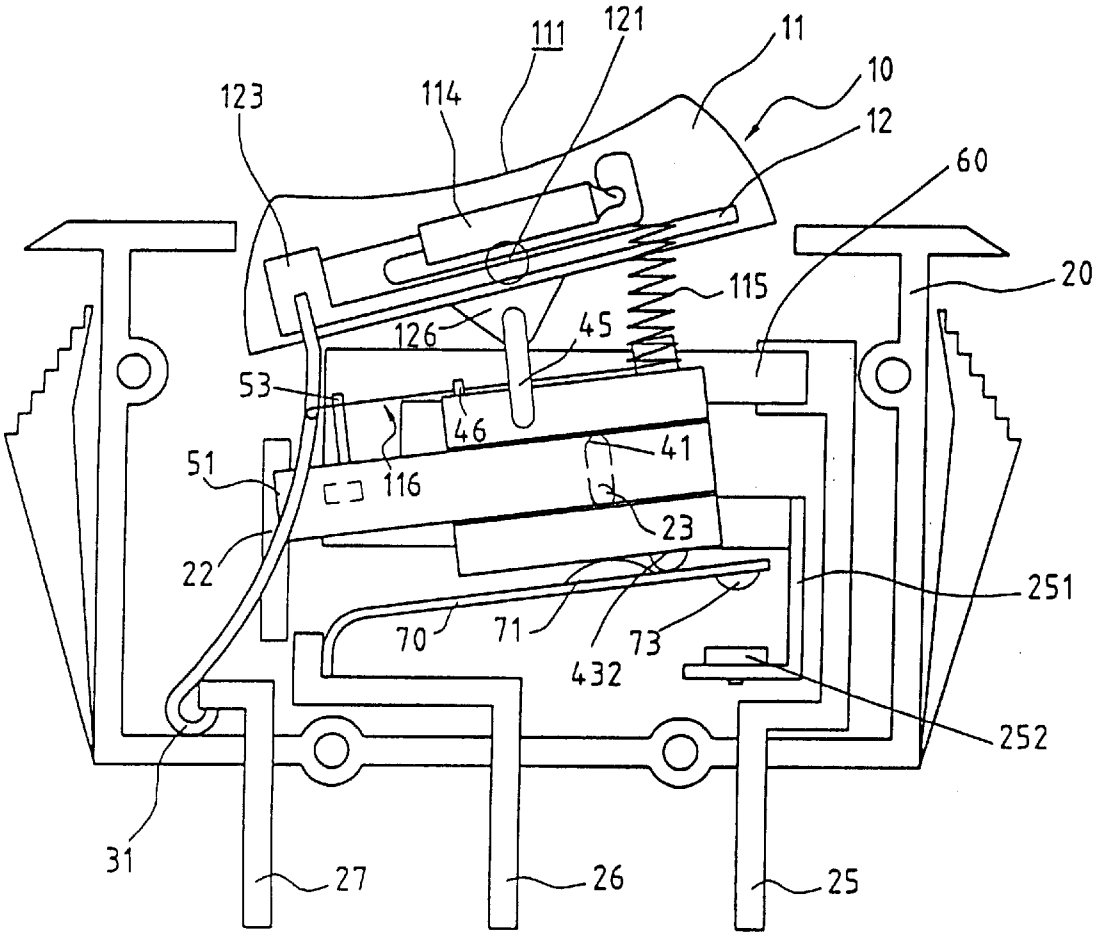

As shown in FIG. 4, the cross sectional view of the tripped state of the switch in the present invention due to current overloading is illustrated. When the switch is overloaded with current, the alloy piece 60 bends towards the control element 40 due to the heat from overloading. The protruded portion 51 of the swinging device 50 is pushed, and thus the swinging device 50 is separated from the stopper 22 at the left and lower end. Then, the swinging device 50 and the control element 40 drop downwards due to no support. Therefore, the protruded portion 51 of the swinging device 50 moves downwards while the through hole 52 at the opposite end moves upwards. As a result, the round head 432 slides away without pressing the round convex portion 71. Then, the elastic contacting piece 70 ejects upwards by a resilient force thereof to separate the lower contact 73 from the upper contract 252.

Thereby, as shown in FIG. 4A, the angle 303 is about 180 degrees. The moment of force 302 can overcome a reaction force, and an elastic force 301 pushes upwards. If the switch 10 is free of any external force applied thereon, the contact reed 30 releases so as to push one end of the switch 10. Then, the switch 10 is rotated to an off position as shown in FIG. 2 around the fulcrum 121. Thus, the control element 40 moves upwards with the supporting rod 45 to restore back to a normal position as shown in FIG. 2. The alloy piece 60 then cools to restore to the original condition. The swinging device 50 is also restored by the elastic force of the elastic element 116.

The elastic contacting piece 70 moves upwards due to separation with the control element 40. Thus, the lower contact 73 does not contact the upper contact 252 and the power supply is cut off. At the same time, the neon lamp 114 is extinguished because of no power input from the second contact terminal 26. Thus, the lower side of the left end of the swinging device 50 is placed on the stopper 22 of the switch case 20 again so as to be turned on next time.

Accordingly, in the present invention, by means of the actions of the alloy piece 60, the swinging device 50 and the control element 40, a reaction is triggered when the switch is overloaded with current so that the elastic contacting piece 70 trips and the circuit is turned off. The switch is restored to an OFF state automatically. The switch of the present invention has a simple structure with quick response and no false action.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A switch structure comprising:

a switch having on and off positions;

an alloy piece having a first end connected to a first contact terminal;

a conducting piece connected to a second end of said alloy piece, said conducting piece having an upper contact;

a control element coupled to said switch;

an elastic contacting piece below said control element, said elastic contacting piece having a first end with a lower contact formed above said upper contact and a second end connected to a second contact terminal, said lower contact being in contact with said upper contact for forming a power supply path from said first contact terminal to said second contact terminal through said alloy piece, said conducting piece, and said elastic contacting piece when said switch is in said on position to control said control element for lowering said lower contact;

a contact reed having a first end coupled to said switch, said contact reed being compressed if said switch is in said on position;

a swinging device coupled and assembled with said control element, said swinging device being positioned against said alloy piece; and a stopper formed within a switch case for supporting said swinging device;

whereby said alloy piece is deformed to push said swinging device as well as said control element off said stopper to raise said lower contact and break said power supply path, and said contact reed is decompressed to restore said switch to said off position if current overloading occurs while said switch is in said on position.

2. The switch structure as claimed in claim 1, said control element further including a helical spring having an upper portion coupled to said switch and a lower portion coupled to a metal rod, said metal rod being protruded downwards from said control element for pressing a convex protruded portion formed on said elastic contacting piece.

3. The switch structure as claimed in claim 2, said helical spring having a distal end extended to form a linear elastic element located between a fulcrum post formed on said control element and a resisting post formed on said swinging device.

4. The switch structure as claimed in claim 3, said switch further including a lighting device embedded therein, said lighting device having a first end connected to a third contact terminal through said contact reed, and a second end connected to said helical spring.

5. The switch structure as claimed in claim 4, said lighting device comprising a neon lamp in series with a resistor.

6. The switch structure as claimed in claim 1, said control element being coupled to said switch by a supporting rod, said supporting rod having a first end received in a hole formed on said control element and a second end received in a hole formed on a triangular piece of said switch.

* * * * *